US006189890B1

(12) United States Patent
Moulin et al.

(10) Patent No.: US 6,189,890 B1
(45) Date of Patent: Feb. 20, 2001

(54) SEALING JOINT FOR SHEET PILES

(75) Inventors: Jean-Michel Moulin, Yutz (FR); André Rix, Messancy (BE)

(73) Assignee: Profilarbed S.A., Esch-Sur-Alzette (LU)

( * ) Notice: Under 35 U.S.C. 154(b), the term of this patent shall be extended for 0 days.

(21) Appl. No.: 09/284,450

(22) PCT Filed: Sep. 24, 1997

(86) PCT No.: PCT/EP97/05225

§ 371 Date: Apr. 12, 1999

§ 102(e) Date: Apr. 12, 1999

(87) PCT Pub. No.: WO98/16691

PCT Pub. Date: Apr. 23, 1998

(30) Foreign Application Priority Data

Oct. 16, 1996 (LU) ..... 88827

(51) Int. Cl.[7] ..... F16J 15/02

(52) U.S. Cl. ..... 277/312; 277/650; 277/935; 405/274

(58) Field of Search ..... 277/312, 316, 277/934, 935, 650; 405/274

(56) References Cited

U.S. PATENT DOCUMENTS 3,784,441 * 1/1974 Kaempen .
4,449,713 * 5/1984 Ishido et al. .
4,670,089 * 6/1987 Hanson .
5,547,318 * 8/1996 Decker .
5,938,210 * 8/1999 Schatzle .

FOREIGN PATENT DOCUMENTS 0 264 527 4/1988 (EP) .
0 352 172 1/1990 (EP) .
454306 9/1936 (GB) .
7012601 3/1971 (NL) .

* cited by examiner

*Primary Examiner*—Terry Lee Melius
*Assistant Examiner*—William L. Miller
(74) *Attorney, Agent, or Firm*—Chapman and Cutler

(57) ABSTRACT

A method of sealing sheet pile joints using a paraffinic product to seal the gripping elements of the sheet piles. The paraffinic products usable for sealing the gripping elements of sheet piles have a drop point lying between 100 and 140° C. and a cone penetration of between 20 and 50 mm/10. In a preferred embodiment, the paraffinic product contains at least 50% paraffin waxes, and may also incorporate mineral oils, bonding agents, antioxidants and/or other normal additives. According to another embodiment, the paraffinic products usable for sealing the gripping elements of sheet piles have a resistance to hydrostatic pressure of at least 0.12 bar/mm, preferably at least 0.22 bar/mm.

13 Claims, No Drawings

SEALING JOINT FOR SHEET PILES

This application is a national phase of International Application PCT/EP97/05225 filed Sep. 24, 1997.

BACKGROUND OF THE INVENTION

1. Field of the Invention

The present invention relates to a sealing joint for sheet piles.

2. Description of the Prior Art

Sheet piles are metallic sections having geometries of varying complexity (Z-shaped, U-shaped or flat sheet piles, for example, or joined together in a caisson), which are assembled to form continuous structures known as sheet-pile walls. Assemblies of sheet piles are used more particularly during work connected with excavation, with the construction of dams, reservoirs and basins for confinement of sewage etc., in order to retain soil and, to a certain extent, water as well.

On site, the sheet piles, which are often assembled two at a time (twinning) at the factory by what are called threading machines, are driven into the ground by ramming, by vibration or by presses to form a metallic wall by virtue of the mutual interlocking between their gripping elements or claws. A certain amount of play in the region of their gripping elements must be allowed so that the sheet piles can easily be interlocked during their assembly, and this naturally forms a source of leakage.

As soon as there is a requirement for the sheet-pile wall to be impervious, whether the imperviousness is to be perfect or as efficient as possible, additional measures must be provided for sealing the gripping elements.

Attempts have been made to seal the sheet-pile wall after being driven in, either by welding the sheet piles to each other, or by pressurised injection of a sealing mass into the interstices of the gripping elements, as described in the German patent application published under no. DE-OS-21 40 250.

These two methods are, however, applicable only if one of the two faces of the sheet-pile wall remains accessible.

If the sheet-pile wall is inaccessible, it is possible to proceed as described in the German patent application published under no. DE-OS-21 42 957 and inject into a gripping element of the sheet piles, even on site and before pile-driving, a mass which is introduced in the liquid state and which solidifies in the form of a foam with an elastic consistency.

Alternatively, it is possible to conform to the German patent application DE-AS 27 22 978, according to which a joint is formed in the gripping element to be interlinked by injecting into it a suitable product, generally polyurethane, and by smoothing out the product by means of a mobile device to give it the desired shape.

The above-mentioned sealing joints have the disadvantage that they offer little resistance to stresses during the interlocking, particularly to shearing. While the sheet piles are being driven in, the gripping elements rub against each other and the sealing joint may be destroyed, at least locally, by the joint being planed down.

The use of these polyurethane-based joints generally requires an elaborate preparation of the gripping element. In fact, it is often necessary to clean the gripping element by sand-blasting and to introduce a product to improve the adhesion of the joint to the steel. In spite of all these precautions, sheet piles incorporating this type of joint cannot be driven in by vibration, since the joints would suffer too much damage during the pile-driving.

SUMMARY OF THE INVENTION

The aim of the present invention is to propose a product to seal the gripping elements of the sheet piles which is both safe from the environmental point of view and which withstands stresses well during pile-driving.

This aim is achieved through the use of a paraffinic product to seal the joints of the sheet piles.

The use according to the invention of a paraffinic product is advantageous, since this product is inert and does not release harmful compounds into the environment.

Because of its consistency and its good plastic deformability, the joint using a paraffinic product is not liable to be destroyed during the interlocking of the sheet piles. It has a better resistance to shear and to other stresses during pile-driving than polyurethane joints.

The sealing of sheet-pile gripping elements using paraffinic products is simpler than it is with polyurethane, because neither sand-blasting the gripping element nor introducing a product to improve adhesion between the steel and the joint are necessary.

Moreover, joints made of paraffinic products are much cheaper than joints made of polyurethane.

To seal the gripping elements of sheet piles, bitumen-based masses for sealing have long been used. These products generally possess an acceptable resistance to shear. However, one of the disadvantages of these sealing products is that, when used in contact with groundwater, certain harmful compounds may be released into the environment.

The use of paraffinic products in the manufacture of sealing joints for sheet-pile gripping elements offers several advantages over the use of bitumen-based products.

The plasticity and deformability when cold of the paraffinic product are significantly superior to those of bitumen-based products. These properties have been confirmed by tests on interlocking of sheet piles.

Paraffinic products have a lubricating power that is superior to that of bituminous products, i.e. sheet piles incorporating a joint made of paraffinic products are generally easier to interlock: the force required to couple together two sheet piles sealed with a paraffinic product is less than that required to couple together sheet piles sealed with a bituminous product.

Joints made with paraffinic products are not degraded by mineral oils, unlike joints made with bituminous products. The resistance of joints made with paraffinic products to petroleum oil and/or motor spirit is significantly greater than that of joints made of bituminous products.

The temperature at which paraffinic products are applied is significantly lower than that for bituminous products. In fact, it is sufficient to heat paraffinic products to temperatures below 140° C. whereas bituminous products must be heated to about 200° C. At these temperatures, bituminous products have a tendency to give off disagreeable smells and overheating may also produce harmful smoke.

During the interlocking of the sheet piles, a certain amount of the sealing product is ejected from the gripping element and must be removed manually. Paraffinic products are removed by scraping with a tool and the surface is easily finished using a solvent based on aliphatic hydrocarbons, such as "Premium Degreaiser" made by Texaco. The amount of paraffinic product ejected is less and it is distributed more homogeneously in the gripping element. The aesthetic appearance of a sheet-pile wall incorporating joints made of paraffinic products is consequently significantly more attractive than that of a sheet-pile wall incorporating joints made of bituminous products.

If sheet piles are reused, the gripping elements must generally be completely cleaned.

In such a case, joints made of bituminous products must be removed using a blowpipe, whereas joints made of paraffinic products are quite simply removed by scraping and possibly by using a solvent.

Another advantage of paraffinic products is that they remain homogeneous even at high temperatures. With bitumen-based products, a local thickening of the bituminous joints due to inhomogeneities is sometimes observed. These thicker regions may lead to difficulties in interlinking the sheet piles. In such cases, the awkward region must be slightly heated in order to facilitate the twinning of the sheet piles.

Another advantage lies in the fact that the joints of paraffinic products may be coloured en masse by adding a dye or coloured pigments to the molten products.

Joints made of paraffinic products may be introduced at the factory or on site before the sheet piles are interlocked.

DETAILED DESCRIPTION OF THE INVENTION

According to a first advantageous embodiment, the paraffinic products usable for sealing the gripping elements of sheet piles have a drop point lying between 100 and 140° C. measured according to the ISO 2176 standard with a Mettler FP5/53 apparatus.

Preferably, the paraffinic products have a cone penetration of between 20 and 50 mm/10 determined according to the ASTM D937/58 method or something equivalent, e.g. NF T60-119.

According to another advantageous embodiment, the paraffinic products usable for sealing the gripping elements of sheet piles have a resistance to hydrostatic pressure of at least 0.12 bar/mm, preferably at least 0.22 bar/mm.

To determine the resistance to hydrostatic pressure, a disc-shaped specimen of known thickness is introduced into an oedometer and screwed into a metallic sleeve. It is subjected to a hydrostatic pressure lying between 0 and 3.5 bar. The pressure is measured by a manometer. The test is stopped when the specimen is mechanically destroyed.

In a preferred embodiment, the paraffinic product contains at least 50% paraffin waxes.

The paraffinic products usable for sealing the gripping elements of sheet piles may also incorporate mineral oils, bonding agents, antioxidants and/or other normal additives.

Other characteristics of the invention are described, as non-limiting illustrations, in the examples.

Different products have been tested and the performances of these products have been compared.

TABLE 1

Products tested

| Product | Composition |
|---|---|
| Beltan | bitumen + lubricant |
| Soprema | elastoplastic bitumen |
| Biguma | elastomeric bitumen |
| Paraf | paraffin |

Various tests were carried out to check:

the introduction of the products into the gripping elements of sheet piles the physical performances the behaviour in relation to various chemicals.

The tests concerned with the introduction of the product are intended to assess the conditions for the introduction of the joint and its behaviour in the gripping elements during the period preceding ramming. The melting point and the fluidity of the product were monitored. The suitability for their introduction on to steel taken to temperatures between −10° C. and 70° C., their adhesion to dry or damp surfaces, and the capacity of the joint to withstand rain and UV radiation during storage are monitored. The results are set out in Table 2.

TABLE 2

Introduction of the different products

| Product | Temperature of use (° C.) | Viscosity of the product on introduction | Suitability according to the state of the steel surface during introduction | | | | Behaviour during storage | |
|---|---|---|---|---|---|---|---|---|
| | | | −10° C. | 25° C. | 70° C. | damp | in rain | UV |
| Beltan | 170 | liquid | OK | OK | OK | OK | OK | OK |
| Soprema | 200 | fairly liquid | OK | OK | OK | OK | OK | OK |
| Biguma | 170 | liquid | OK | OK | OK | OK | OK | OK |
| Paraf | 120 | very liquid | OK | OK | OK | OK | OK | OK |

The physico-chemical performance of the joints was also tested. These physico-chemical tests are carried out on the resistance of the joints to water pressure, on the consistency of the products in a vertical position when subjected to temperatures up to 80° C. and on the compatibility with various chemical agents.

TABLE 3

Physico-chemical tests

| Product | Resistance to pressure (bar/mm) | Consistency of the solidified product | Performance in vertical position, heated Max temp before destruction | Chemical resistance pH 2 | pH 12 | sea water | oil | petroleum oil | motor spirit |
|---|---|---|---|---|---|---|---|---|---|
| Beltan | 0.08 | semi-hard | 70 | G | G | G | Av | P | P |
| Soprema | >0.22 | hard, elastic | 80 | G | G | G | Av | P | P |
| Biguma | 0.19 | semi-hard, elastic | 80 | G | G | G | Av | P | P |
| Paraf | 0.22 | fairly soft | 70 | G | G | G | G | Av | Av |

G = good, Av = average, P = poor

In order to determine whether the joints discharge certain toxic products when they are in contact with water, specimens with identical contact areas were subjected to contact with water for 48 hours according to the DIN 38414-S4 method. The concentrations of lead (Pb), polycyclic aromatic hydrocarbons (PAH) and of a combination of five volatile aromatic products (BTEX)—benzene, toluene, ethylbenzene, m-p-xylene and o-xylene—were determined according to the DIN 38407 method. The results are given in Table 4.

TABLE 4

Toxic discharges from sheet pile joints

| Product | Pb (μg/l) | PAH (μg/l) | BTEX (μg/l) |
|---|---|---|---|
| Beltan | <1 | 0.4 | <0.1 |
| Soprema | <1 | 0.3 | <0.1 |
| Biguma | <1 | <0.1 | <0.1 |
| Paraf | <1 | <0.1 | <=0.1 |
| Authorised limits | 40 | 0.2 | 30 |

Only two of the four products pass the test.

The authorised limits are those laid down by the laws of the German State of Bavaria in its document "Altlastenleitfaden für die Behandlung von Altablagerungen und kontaminierten Standorten in Bayern" [Residual contamination guidelines for the treatment of abandoned waste tips and contaminated sites in Bavaria] published in 1992 by the Bayrisches Staatsministerium für die Landesentwicklung und Umweltfragen [Bavarian State Ministry for Rural Development and Environmental Matters].

The performance of the joints in the gripping elements during interlocking was examined on a standard twinning line. The aim of the tests was to study the adhesion and lubricating effect of the products and any possible buckling problems.

The tests were carried out with 6-meter long AZ18 sheet piles. Before the products were introduced, a gripping element of each sheet pile was prepared according to the recommendations described in "Le rideau de palplanches étanche" [The sealed sheet-pile wall] published in 1993 by International Sheet Piling Company S.a.r.l. (Luxembourg).

For these tests only one of the two gripping elements was filled with the sealing product.

The products were heated until they were molten and were poured into the gripping elements to form a joint with a thickness lying between 4 and 8 mm. The following table summarises the important characteristics relating to the application of the products, particularly the melting point, the viscosity of the molten product, the smoke emitted by the products when heated up and an assessment of the quality of the joint introduced into the gripping elements.

TABLE 5

Behaviour of the products when hot

| Product | Melting point | Viscosity | Smoke | Assessment |
|---|---|---|---|---|
| Beltan | 160–180 | fairly fluid | average | fairly good |
| Soprema | 160–180 | fairly fluid | average | fairly good |
| Biguma | 180–220 | fairly pasty | large amounts | fairly poor |
| Paraf | 120–160 | fluid | none | good |

The interlocking tests were carried out on a standard twinning line and took place in two stages:

the first three meters of each sheet pile were interlocked manually, i.e. slowly, so as to be able to assess the adhesion of the product in the gripping element;

the last three meters were interlocked automatically at 0.8 m/s so as to be able to measure the force required for assembly and hence to evaluate the degree of lubrication provided by each product.

The results of these tests are summarised in Table 6.

TABLE 6

Appearance of joints after interlocking

| Product | State of joint | Filling | Pressure | Assessment |
|---|---|---|---|---|
| Beltan | sheared | good | 120 | good |
| Biguma | sheared | good | 120 | good |
| Soprema | torn | good | >170 | poor |
| Paraf | scraped | good | 120 | good |

The way in which the surplus product is ejected from the gripping element depends on the flexibility of the product. If it is hard, it tears; if it is soft, it has a tendency to be scraped instead. In general, it was observed that the ejection of the surplus product occurred mainly in front of the sheet pile which is interlinked. In some way, it planes down the surplus product.

The tests showed that it was impossible to interlock sheet piles using the "Soprema" product. This product was apparently too hard and obstructed the operation of assembly.

What is claimed is:

1. Method of sealing a sheet pile joint, comprising steps of:

providing a paraffin product having a drop point between 100 and 140C;

melting the paraffin product; and pouring the paraffin product in at least one of two gripping elements forming the joint for sheet piles.

2. Method according to claim 1, wherein the paraffin product has cone penetration between 20 and 50 mm/10.

3. Method according to claim 2, wherein the paraffin product includes at least 50% of paraffin waxes.

4. Method according to claim 3, wherein the paraffin product further includes paraffin oils, mineral oils, bonding agents, and antioxidants.

5. Method according to claim 4, wherein the paraffin product further includes dyes or colored pigments.

6. Method according to claim 2, wherein the paraffin product has a resistance to hydrostatic pressure of at least 0.12 bar/mm.

7. Method according to claim 6, wherein the paraffin product has a resistance to hydrostatic pressure of at least 0.22 bar/mm.

8. Method according to claim 7, wherein the paraffin product includes at least 50% of paraffin waxes.

9. Method according to claim 8, wherein the paraffin product further includes paraffin oils, mineral oils, bonding agents, and antioxidants.

10. Method according to claim 9, wherein the paraffin product further includes dyes or colored pigments.

11. Method according to claim 6, wherein the paraffin product includes at least 50% of paraffin waxes.

12. Method according to claim 11, wherein the paraffin product further includes paraffin oils, mineral oils, bonding agents, and antioxidants.

13. Method according to claim 12, wherein the paraffin product further includes dyes or colored pigments.

* * * * *